US005992842A

United States Patent [19]

Dickhoff

[11] Patent Number: 5,992,842

[45] Date of Patent: Nov. 30, 1999

[54] APPARATUS FOR TRANSPORTING SHEET-LIKE MATERIAL

[75] Inventor: Andreas Dickhoff, Kirchheim-Teck, Germany

[73] Assignee: Eastman Kodak Company, Rochester, N.Y.

[21] Appl. No.: 08/946,320

[22] Filed: Oct. 7, 1997

[30] Foreign Application Priority Data

Dec. 5, 1996 [DE] Germany ..... 196 50 423

[51] Int. Cl.[6] ..... B65H 3/44; B65H 5/26

[52] U.S. Cl. ..... 271/9.13; 271/264; 271/272

[58] Field of Search ..... 271/9.01, 9.04, 271/9.13, 264, 272, 273, 303

[56] References Cited

U.S. PATENT DOCUMENTS

| | | | |
|---|---|---|---|
| 4,256,299 | 3/1981 | Hogenson | 271/272 |
| 4,537,497 | 8/1985 | Masuda . | |
| 4,678,178 | 7/1987 | Akiyama et al. | 271/273 |
| 4,729,282 | 3/1988 | Kasdopf | 271/303 |

FOREIGN PATENT DOCUMENTS

| | | | |
|---|---|---|---|
| 404272043 | 9/1992 | Japan | 271/273 |

*Primary Examiner*—H. Grant Skaggs
*Attorney, Agent, or Firm*—Lawrence P. Kessler

[57] ABSTRACT

A transport roller unit, which has a plurality of rollers arranged next to one another on a bearing shaft, rests against the transport rollers of a transport roller pair. The rollers are mounted independently rotatably on bearing bushings that are joined positively to the bearing shaft. The rollers are associated with a first and a second roller group, of which the first roller group is mounted, offset by an amount (x), eccentrically with respect to the longitudinal axis of the pressure roller unit. The second roller group is mounted offset, by the same amount (x) in the opposite direction to the rollers of the first roller group, eccentrically with respect to the longitudinal axis of the pressure roller unit. The rollers are arranged in such a way that of each two rollers arranged next to one another, one is associated with the first roller group and one with the second roller group. The rollers of the first roller group rest nonpositively against the one transport roller, and the rollers of the second roller group rest against the other transport roller.

10 Claims, 5 Drawing Sheets

APPARATUS FOR TRANSPORTING SHEET-LIKE MATERIAL

FIELD OF THE INTENTION

The invention relates to an apparatus for transporting sheets, having a driven transport roller pair.

The invention further relates to an apparatus for transporting sheets, having a transport roller and a pressure roller.

BACKGROUND OF THE INVENTION

A copier is known U.S. Pat. No. 4,537,497 which has a transport apparatus having a first driven transport roller pair to which copied sheets, which can be taken from a variety of supply stacks arranged vertically in different planes, are delivered. Associated with the respective supply stacks are second driven transport roller pairs which transport to the first transport roller pair a copied sheet that has been decollated from a supply stack. The arrangement and drive system of the second transport roller pair of this known apparatus require a great deal of space, and are relatively complex.

It is the object of the invention to configure a transport apparatus of the generic type in such a way that a space-saving arrangement and simple drive system therefor are achieved.

SUMMARY OF THE INVENTION

According to the invention, this object is attained in that a pressure roller unit resting against both transport rollers simultaneously is associated with the transport rollers of the transport roller pair. The pressure roller unit has a plurality of rollers arranged next to one another and each independently rotatably mounted. The pressure roller unit has a first and a second roller group with rollers, of which the rollers of the first roller group are mounted eccentrically by an amount x with respect to the longitudinal axis of the pressure roller unit, and the rollers of the second roller group are mounted eccentrically by the same amount x, in the opposite direction from the rollers of the first roller group, with respect to the longitudinal axis of the pressure roller unit. The rollers are arranged in such a way that of each two rollers arranged next to one another, one is associated with the first roller group and one with the second; and that the rollers of the first roller group rest nonpositively against the one transport roller, and the rollers of the second roller group against the other transport roller.

This is moreover achieved, according to the invention, in that the pressure roller associated with the transport roller is configured as a pressure roller unit having a plurality of rollers arranged next to one another and each independently rotatably mounted. The pressure roller unit has a first and a second roller group with rollers, of which the rollers of the first roller group are mounted eccentrically by an amount x with respect to the longitudinal axis of the pressure roller unit, and the rollers of the second roller group are mounted eccentrically by the same amount x, in the opposite direction from the rollers of the first roller group, with respect to the longitudinal axis of the pressure roller unit. The rollers are arranged in such a way that of each two rollers arranged next to one another, one is associated with the first roller group and one with the second; and that the rollers of the first roller group rest nonpositively against the transport roller and the rollers of the second roller group can be driven in independently rotatable fashion in the opposite direction.

The configuration and arrangement according to the invention make it possible, in advantageous fashion, for only a single pressure roller unit to be necessary in order to transfer to the transport roller pair sheets delivered from two different levels, without requiring an additional drive system for the pressure roller unit.

The arrangement of a second pressure roller unit, or a plurality of roller units, in engagement with the transport rollers of the transport roller pair makes it possible to bring together multiple sheet delivery paths at the input roller gap of the transport roller pair, again without thereby requiring an additional drive system for the further pressure roller units.

The pressure roller unit according to the invention can, according to another application, also be in engagement with only one single transport roller; both the transport roller and the pressure roller are then movable in rolling fashion on a flat surface.

The pressure roller unit has, advantageously, a bearing shaft with a rectangular cross section on which bearing bushings for rotatable mounting of the rollers of the pressure roller arrangement are arranged, the bearing bushings being joined positively to the bearing shaft.

In an advantageous embodiment of the invention, the bearing bushings are equipped at one end with a shoulder which defines the axial position of a slid-on roller and at the same time ensures definition of the mutual positions of the bearing bushings and rollers arranged next to one another, in such a fashion that the rollers are mounted to rotate freely.

In a further embodiment of the invention, the bearing bushings are equipped at the ends with a recess which is concentric about the eccentric offset of the bearing region and into which the running surface of an adjacent bearing bushing, rotated through 180 degrees, engages, so that the mutually rotated arrangement of the bearing bushings and thus their functionally correct eccentric offset by an amount x is guaranteed.

Further features and advantages are evident from the description of an exemplified embodiment of the invention that is depicted in the drawings, and from the subclaims.

BRIEF DESCRIPTION OF THE DRAWINGS

In the schematic drawings

DETAILED DESCRIPTION OF THE INVENTION

Figure 1:
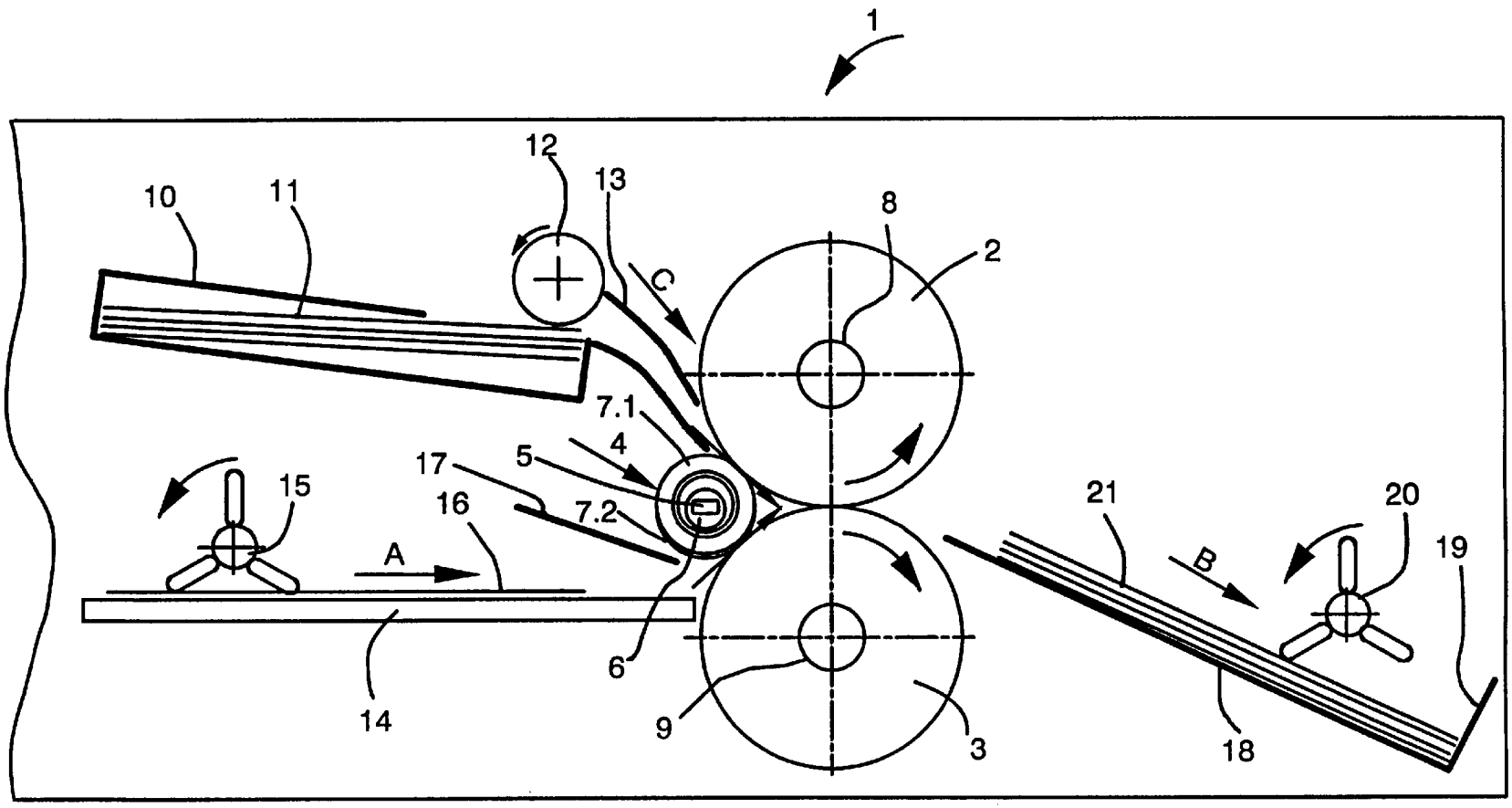
FIG. 1 shows the apparatus in a side view.

The invention has been described in detail with particular reference to certain preferred embodiments thereof, but it will be understood that variations and modifications can be effected within the spirit and scope of the invention. The apparatus according to the invention is, for example, part of a finisher 1 into which copied sheets 16 output from a copier (not depicted) of known type are fed and are then, in a collection container 18, collected in stacks and optionally stapled together in sets by means of staples. Finisher 1 is equipped with an input tray 10 of known type, from which sheets can be removed and introduced into the distribution process. A finisher of this kind is known, for example, from U.S. Pat. No. 5,108,082. All that is depicted of the finisher selected as the exemplified embodiment are those components required for an understanding of the invention.

In the finisher 1, a transport roller pair 2, 3 that is in nonpositive engagement is mounted in stationary and rotatable fashion and driven in arrow direction "B". Associated with the input gap of transport roller pair 2, 3 is a pressure roller unit 4, yet to be described, which rests nonpositively against transport rollers 2 and 3 simultaneously.

Arranged below pressure roller unit 4 is a sheet guide 14 on which copied sheets 16 output from the upstream copier are transported in arrow direction "A" to pressure roller unit 4. Copied sheets 16 are transported, for example, by the transport means of a fixing station (of known type) of the upstream copier or, as depicted in FIG. 1, by frictionally acting transport means, for example a vane wheel with flexible vane arms of known type. A guide element 17 of ordinary type, positioned above guide 14 and arranged tilted downward obliquely in the transport direction, ensures that the sheet is guided reliably onto the roller gap between pressure roller unit 4 and transport roller 3.

Arranged above pressure roller unit 4 is the aforementioned input tray 10 of known type, which stores a stack 11 of sheets that can be decollated by friction, by means of a decollating roller 12 of known type, from stack 11 and fed via a guide channel 13 to pressure roller unit 4. The sheets in stack 11 can, for example, in known fashion, be separator sheets, title or cover sheets, preprinted inserts, films, or the like that are fed into the distribution process according to a programmed sequence (of a type not depicted) entered by the user.

A sheet released by transport rollers 2, 3 passes into a collection station 18, arranged in downwardly tilted fashion, in which the sheet is laid, by a vane wheel 20 with flexible vane arms of known type arranged above a sheet stack 21 being distributed, against a front delimiter 19 where they are aligned.

Pressure roller 4, which consists of bearing shaft 5 with bearing bushings 6 slid thereonto and rollers 7 mounted thereon, is described below:

Bearing shaft 5 has a substantially rectangular cross section and is arranged in stationary and rigid fashion on finisher 1. A plurality of identical bearing bushings 6, which are joined positively and displaceably to bearing shaft 5 by appropriate shaping of their bearing region 6*a*, are arranged on bearing shaft 5. Bearing bushings 6 have a cylindrical running surface 6*b* on which identical rollers 7, configured with rotational symmetry and equipped with a bore 7*a*, are mounted so as to rotate freely.

Arranged at one end of each bearing bushing 6 is a shoulder 6*c* which has a greater diameter than running surface 6*b*. Shoulder 6*c* serves, with a first side surface 6*f* facing running surface 6*b*, to define the axial position of roller 7, while a second side surface 6*d*, facing an adjacent bearing bushing 6, of shoulder 6*c* defines the axial position of roller 7 mounted on the adjacent running surface 6*b*.

Figure 3:
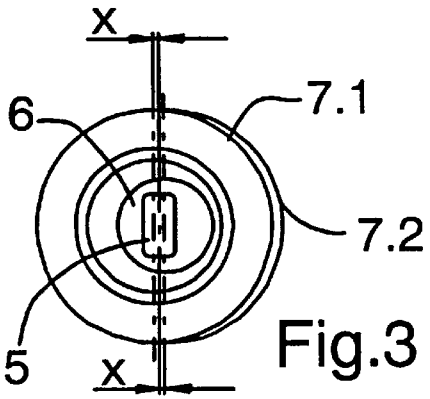
FIG. 3 shows a side view of the drive roller unit according to FIG. 2.

Bearing region 6*a* of bearing bushing 6 is offset eccentrically from the center axis of running surface 6*b* by an amount "x" of, for example, 0.7 mm (see FIG. 3).

A circular depression 6*e* is arranged on the second side surface 6*d* of bearing bushing 6 which faces running surface 6*b* of an adjacent bearing bushing 6 slid onto bearing shaft 5. Depression 6*e* is offset once again by the same amount "x" with respect to the above-described eccentric offset of bearing region 6*a*, so that depression 6*e* is eccentrically offset by twice the amount "x" from running surface 6*b* of bearing bushing 6. This ensures that bearing bushings 6 can be slid onto bearing shaft 5 only in a functionally correct orientation with respect to one another, as will be explained later in detail.

Rollers 7 have at their two opposite ends identical, symmetrical recesses 7*c* which, in the assembled state, overlap shoulder 6*c* of bearing bushing 6 although the ends of adjacent rollers 7 do not touch. End surfaces 7*d* of recesses 7*c* of rollers 7 are arranged so that they allow free rotation of rollers 7 on running surfaces 6*b* and between the first and second side surfaces 6*f* and 6*d* of adjacent bearing bushings 6.

Figure 2:
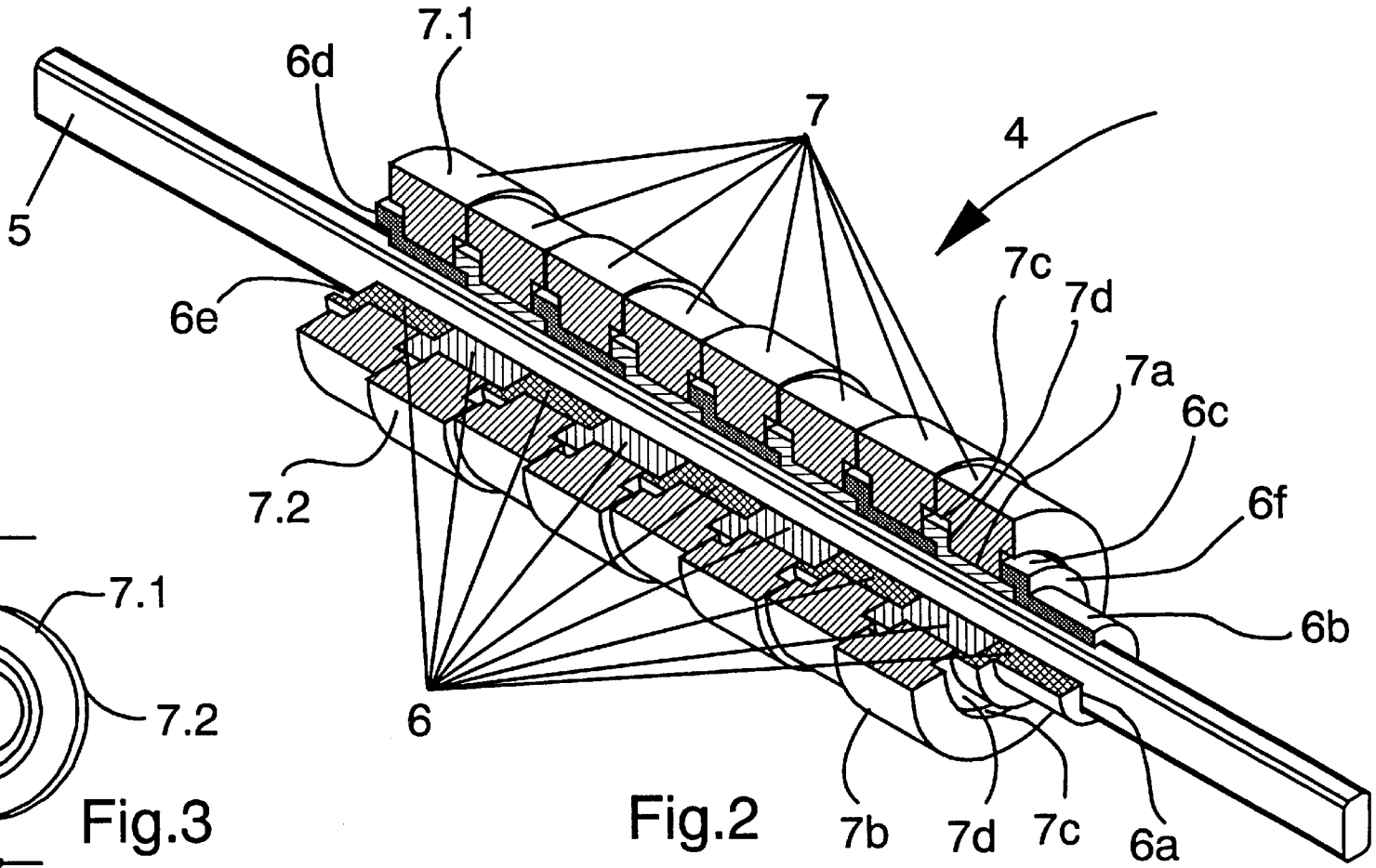
FIG. 2 shows an oblique view of a drive roller unit according to FIG. 1, partly in section.

Pressure roller unit 4 is assembled as follows:

Referring to FIG. 2, first a bearing bushing 6 is slid, shoulder 6*c* first, from right to left onto bearing shaft 5. Then a roller 7 is placed from the same direction onto running surface 6 of bearing bushing 6. The next bearing bushing 6 is also slid onto bearing shaft 5, shoulder 6*c* first but rotated 180 degrees about its longitudinal axis, until it comes to rest against bearing bushing 6 that was slid on first. A roller 7, whose outside diameter is now offset by an amount "x times 2" with respect to roller 7 placed on first, is then placed onto running surface 6*b* of said bearing bushing 6. This assembly operation is continued, alternating as described, until the desired length of pressure roller unit 4 is achieved. To conclude, one further bearing bushing 6 once again rotated 180 degrees with respect to its predecessor, is slid onto bearing shaft 5.

Two roller groups 7.1 and 7.2 are now present on the completely assembled pressure roller unit 4, each with a number of rollers 7 that, as is evident particularly from FIG. 2, are arranged (only one roller of the two roller groups being shown in order to simplify the depiction) so that each roller 7 of the one roller group 7.1 is arranged with an eccentric offset of "x times 2" with respect to the adjacent roller 7 of the other roller group 7.2.

Functionally correct assembly of the mutually offset rollers 7 is facilitated and ensured by the fact that depression 6*e* on shoulder 6*c* of each bearing bushing 6 is arranged, as already described, at an offset of twice the amount "x" with respect to running surface 6*b* of bearing bushing 6. As a result, two adjacent bearing bushings 6 can be installed in functionally correct contact against one another only in the position offset 180 degrees from one another.

The end regions of pressure roller unit 4 are axially secured by means that are not depicted, such as transverse pins, locking rings, or snap-lock elements, or in the case of insertion into a housing are fastened by means of a corresponding housing-mounted delimiter (not depicted).

Bearing shaft 5 is produced from steel, while bearing bushings 6 and rollers 7 are preferably made of a suitable plastic and can be manufactured using an injection method of known type. Rollers 7 can also, in a known manner (not depicted), consist of a plastic core suitable for sliding purposes, on which a peripheral surface of plastic, rubber, or the like, suitable for transport purposes, is applied by injection or fastened.

Bearing shaft 5 is arranged in the housing (not depicted) of finisher 1, secured against rotation, in such a way that the longest extension of the rectangular cross section of bearing shaft 5 runs in the direction in which pressure roller unit 4 is pressed on. This results in the greatest possible flexural strength for bearing shaft 5 and thus for the entire pressure roller unit 4.

Once pressure roller unit 4 is installed, according to FIG. 1 rollers 7 of the one roller group 7.1 of pressure roller unit 4 rest nonpositively against folding roll 2, while rollers 7 of the other roller group 7.2 of pressure roller unit 4 rest nonpositively against folding roll 3. Driven folding rolls 2, 3 drive the two roller groups 7.1 and 7.2 of pressure roller unit 4, the rollers 7 of which are mounted so as to rotate independently, in opposite rotation directions.

The apparatus as shown in FIGS. 1 to 3 operates as follows:

A sheet entering in transport direction "A" is transported by transport roller 3 and roller 7 of pressure roller unit 4 resting against it, and after passing through transport rollers 2, 3 falls in arrow direction "B" into collection station 18. Vane wheel 20 then aligns the sheet against stop 19.

A sheet retrieved from input tray 10, which can be a separator, title, or cover sheet or a printed insert or film, is transported by decollating roller 12 into guide channel 13. From there the sheet passes in arrow direction "C" between transport roller 2 and roller 7 of pressure roller unit 4 resting against it, which guides the sheet to transport roller pair 2, 3 which then transports the sheet in arrow direction "B" into collection container 18.

The sheets that pass in arrow direction "A" or "B" into the working area of pressure roller unit 4 cannot be misfed, since rollers 7 of the two roller groups 7.1 and 7.2 of pressure roller unit 4 are driven in opposite directions to one another and toward the infeed roller gap of roller pair 2, 3, so that the sheets must pass into the roller gap of transport rollers 2, 3.

In another exemplified embodiment depicted in FIGS. 4 and 5 and described below, three transport paths to transport roller pair 2, 3 are brought together with the use of two pressure roller units 4.1 and 4.2 of the type described above; components remaining unchanged are given unchanged reference characters. For clearer depiction of the allocation of rollers 7 of the individual roller groups 7.1 and 7.2 of pressure roller units 4.1 and 4.2 to the respective adjacent rollers, the eccentric offset "x" of rollers 7 is depicted at enlarged scale.

Figure 4:
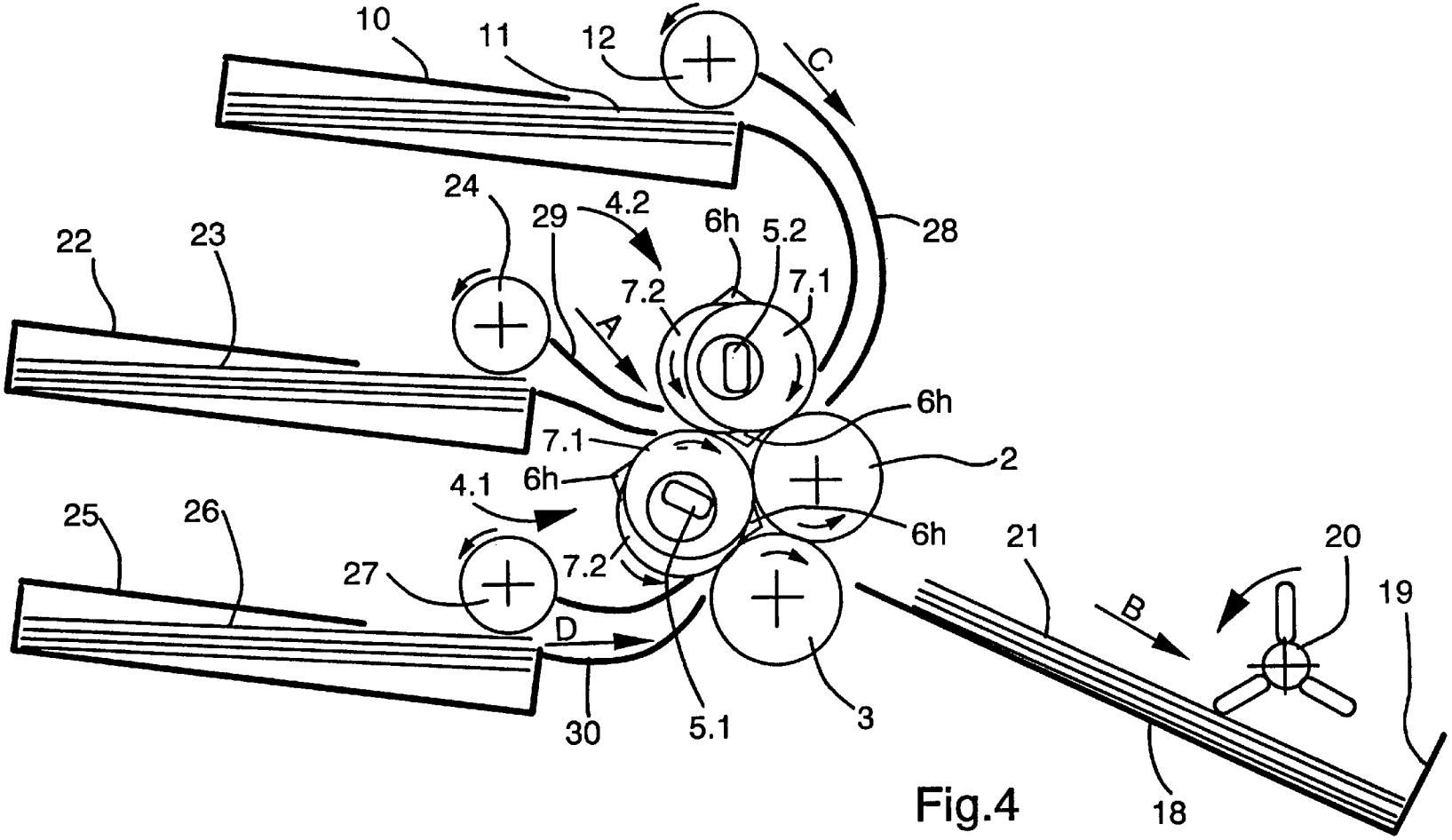
FIG. 4 shows a further exemplified embodiment of the apparatus in a side view.

The apparatus depicted in FIG. 4 can be used to deliver different sheets to a collection container 18 according to a programmed sequence entered by the user.

Unlike the exemplified embodiment according to FIGS. 1 to 3, in the exemplified embodiment according to FIG. 4, in addition to first pressure roller unit 4.1 resting against the two transport rollers 2 and 3, a second pressure roller unit 4.2 identical to the first is provided. Second pressure roller unit 4.2 rests simultaneously against transport roller 2 and first pressure roller unit 4.1. Pressure roller unit 4.2 is arranged so that rollers 7 of the one roller group 7.1 of pressure roller unit 4.2 rest nonpositively against transport roller 2, while rollers 7 of the other roller group 7.2 of pressure roller unit 4.2 rest nonpositively against roller group 7.1 of first pressure roller unit 4.1.

Transport rollers 2 and 3 and rollers 7 have identical diameters. Here again, the extensions of the respective bearing shafts 5.1 and 5.2 are arranged so that they run in the pressure direction of the respective pressure roller unit 4.1 and 4.2 in order to guarantee the greatest possible flexural strength.

The arrangement and allocation of second pressure roller unit 4.2 create a further paper transport path with no need for a second drive system.

The apparatus according to FIG. 4 has three input trays 10, 22, and 25, arranged vertically above one another, with which decollating rollers 12, 24, 27 of known type are associated and in each of which a stack 11, 23, 26, respectively, of sheets is deposited. The sheets in stacks 11, 23, and 26 can be selected by intended purpose (e.g. separator sheets, cover sheets, film, or the like).

From input tray 10, a guide channel 28 leads to the roller gap between transport roller 2 and rollers 7, associated therewith, of pressure roller unit 4.2. A guide channel 29 is arranged between input tray 22 and the roller gap of the mutually associated rollers 7 of the two pressure roller units 4.1 and 4.2. A further guide channel 30 is located between input tray 22 and the roller gap between transport roller 3 and rollers 7, associated with the latter, of pressure roller unit 4.1.

The apparatus as shown in FIG. 4 operates as follows:

Governed by the programmed sequence entered by the user or a sequence entered manually by means of known selector buttons, sheets are transported individually, via guide channel 28 in arrow direction "C" or via guide channel 29 in arrow direction "A" or via guide channel 30 in arrow direction "D", to the associated roller pairs.

A sheet entering in arrow direction "A" thus passes by the associated rollers 7 of pressure roller units 4.1 and 4.2, then the roller gap between transport roller 2 and the rollers 7 of pressure roller unit 4.1, and then transport rollers 2 and 3.

A sheet entering in arrow direction "C" passes by the associated rollers 7 of pressure roller unit 4.2 and transport roller 2, then the roller gap between transport roller 2 and the rollers 7 of pressure roller unit 4.1, and then transport rollers 2 and 3.

A sheet entering in arrow direction "D" passes by the associated rollers 7 of pressure roller unit 4.1 and transport roller 3, and then the roller gap between transport rollers 2 and 3.

After being released by transport rollers 2 and 3, the sheets fall in arrow direction "B" into a collection container 18, and are there aligned against a stop 19 by a vane wheel 20 of known type.

Figure 5:
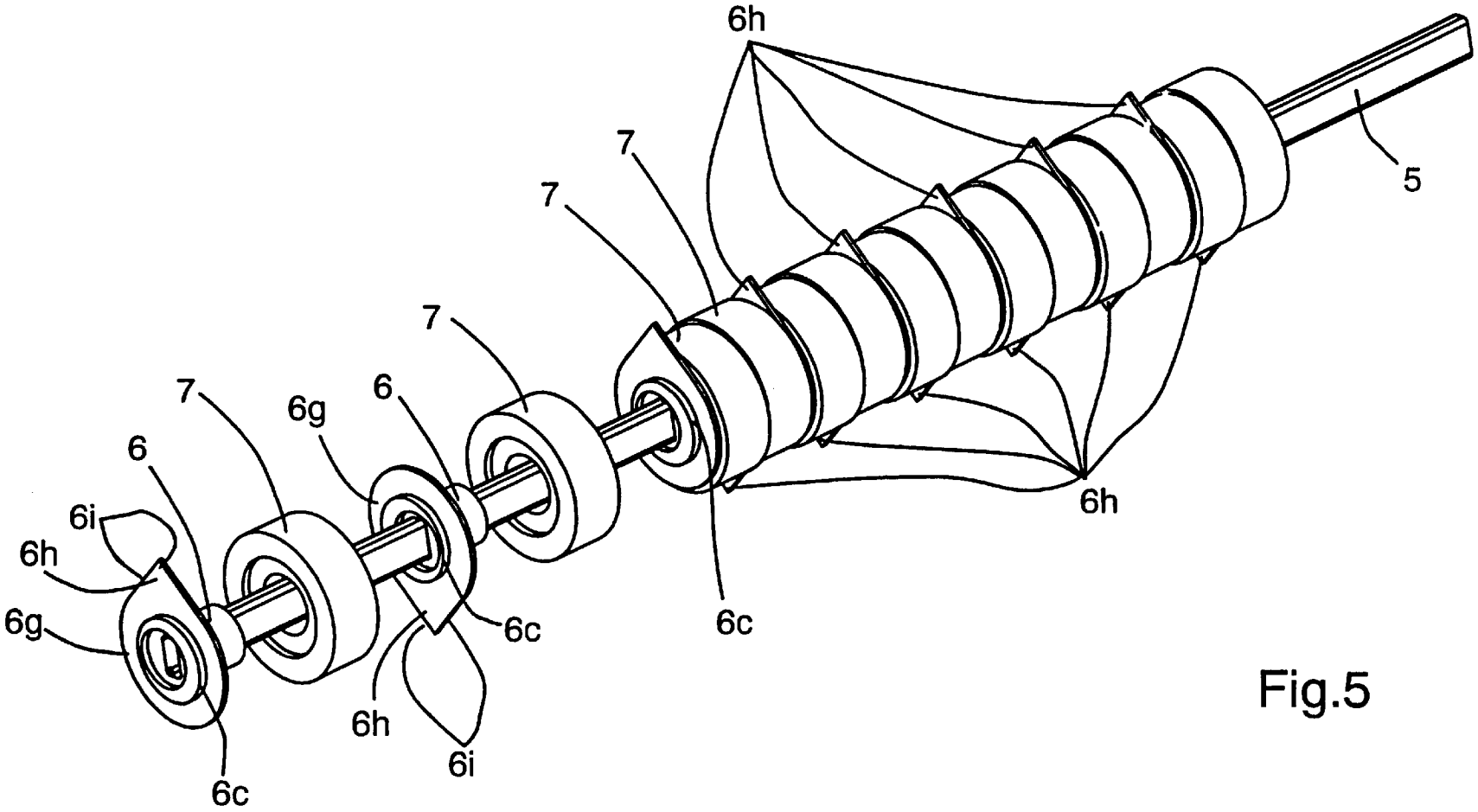
FIG. 5 shows an oblique view of a drive roller unit according to FIG. 4.

The apparatus according to FIGS. 4 and 5 is, however, advantageously also suitable for simultaneous delivery of two or even three sheets, for example in order to laminate a sheet on one side or both sides. To this end, all that is initially necessary is to control the delivery of the sheets decollated out of input trays 10, 22, and/or 25 in a manner adjusted to one another so that the sheets are fed into transport rollers 2 and 3 simultaneously and therefore congruently.

It is necessary for this purpose to guide the front edges of the sheets simultaneously meeting one another inside roller arrangement 2, 3, 4.1, and 4.2 in such a way that no transport malfunctions or sheet damage can occur. To this end, the required control of functionally correct operation of the drive means is accomplished via known control means (not depicted), preferably with the use of stepping motors and sensors (not depicted) arranged in the transport path of the sheets.

Functionally correct guidance of the sheets being simultaneously fed in is achieved by means of guide elements that are shaped onto the shoulder **6*c* of each bearing bushing 6 and each arranged between two adjacent rollers 7 (see FIGS. 4 and 5**).

The guide elements have a disk-shaped region **6*g* which has a smaller outside diameter than rollers 7, and a projection 6*h* protruding beyond the outside diameter of rollers 7. Projection 6*h* has guide surfaces 6*i* arranged symmetrically in a roof shape. The location of projections 6*h* is selected so that their guide surfaces 6***i* constitute a guide channel to the respective downstream roller pair (see FIG. 4).

Since guide elements 6*g*, 6*h* are shaped onto bearing bushings 6, they are also each offset 180 degrees to one another upon assembly of pressure roller units 4.1 and 4.2 (see especially FIG. 5). Because bearing bushings 6 are produced along with guide elements 6*g*, 6*h* as identical parts, a plurality of projections 6*h* offset 180 degrees to the rear project into the rear open space of the finisher, without impairing the operation of the apparatus (see FIG. 4).

In order to manufacture laminated sheets, it is necessary to heat one of transport rollers 2, 3 or both transport rollers 2, 3 in a known manner (not depicted). Such heating could be accomplished, for example, by means of the heated fixing rollers of a fixing station of copier of known type (not depicted). When the sheets are fed into transport rollers 2 and 3, the adhesive of the sheets suitable for the purpose is activated by heating, and the combined sheets are joined in known fashion and the completed laminate is delivered into collection station 18 in arrow direction "B".

Unlike the exemplified embodiment according to FIG. 4, it is also entirely possible to provide, instead of input tray 22, a direct sheet infeed path for the sheets emerging from the copier (by analogy with the description of FIG. 1), so as then to perform a standard sheet distribution with selective insertion of spacer sheets, films, or the like from input trays 10 and/or 25, as described.

Referring to FIG. 4, it is also possible to arrange beneath pressure roller unit 4.1 a further pressure roller unit 4 (not depicted) which then rests nonpositively against pressure roller unit 4.1 and transport roller 3. Arranging an additional pressure roller unit 4 in this fashion makes possible a further paper delivery path, which offers the same advantages and capabilities as the apparatus described with reference to FIG. 4, once again without requiring an additional drive system.

A further exemplified embodiment of the use of a pressure roller unit 4 is described below with reference to FIG. 6.

Figure 6:
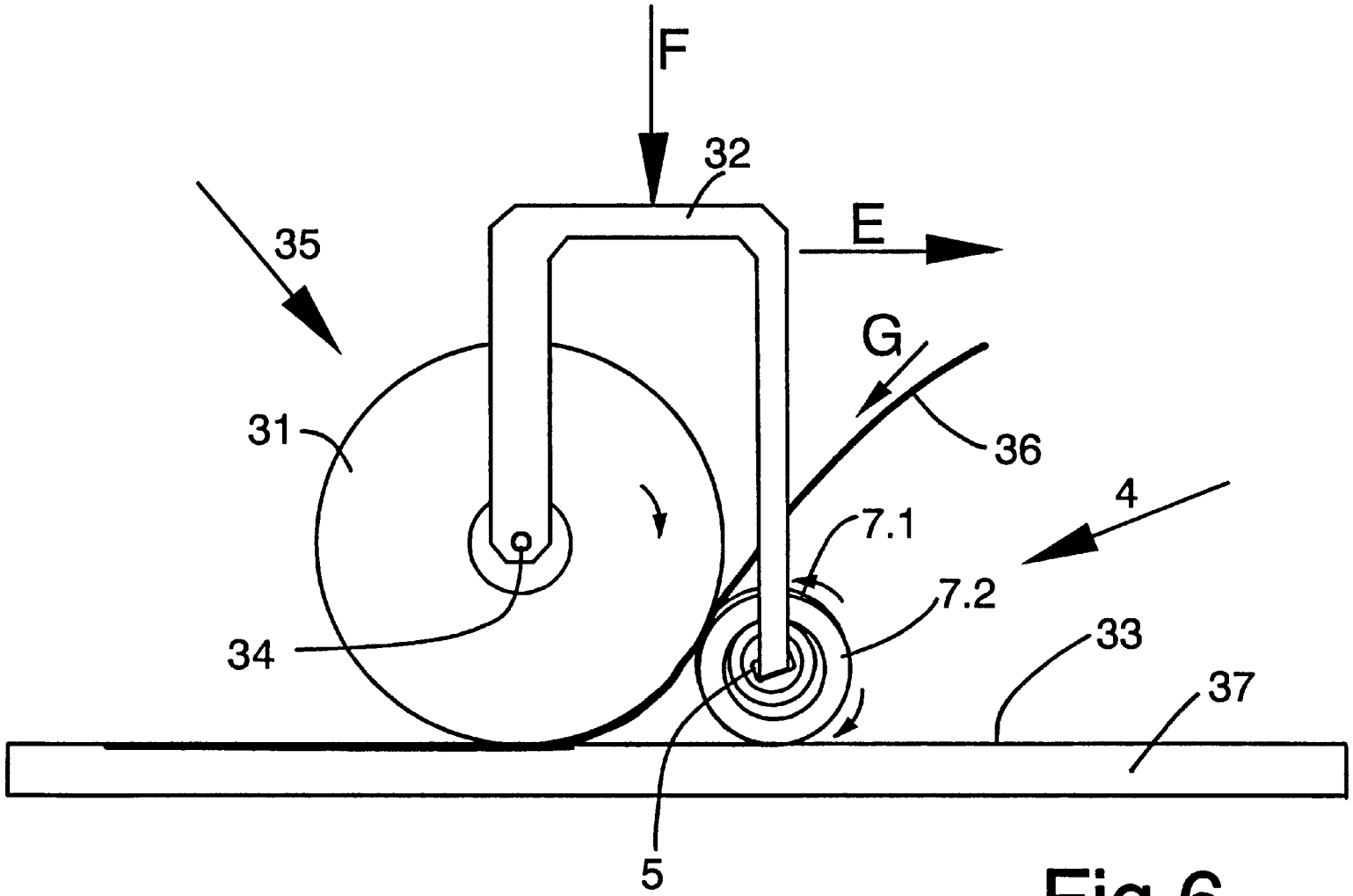
FIG. 6 shows a further exemplified embodiment of the apparatus, in a simplified depiction and in a side view.

Apparatus 35 according to FIG. 6 has a roller 31 that is mounted, rotatably about a bearing 34, on a U-shaped carrier 32 that is movable in arrow direction "E". A pressure roller unit 4 configured in accordance with FIG. 2 is also attached on carrier 32. Pressure roller unit 4, which as already described above has two roller groups 7.1 and 7.2, offset eccentrically with respect to one another, having rollers 7, rests with the one roller group 7.1 nonpositively against roller 31. Rollers 7 of the other roller group 7.2 of pressure roller unit 4 and roller 31 rest, as is evident from FIG. 6, on a flat surface 33. Carrier 32 is acted upon by a force acting in arrow direction "F" which presses roller 31 and rollers 7 of roller group 7.2 associated with surface 33 against surface 33, in each case with the same force.

With this apparatus it is possible to apply film-like material (for example sheets) onto a flat surface 33 or apply them onto a support, for example a sheet, arranged on a flat surface 33.

To this end, apparatus 35 is moved in arrow direction "E"; a sheet or a film 36 is thereby guided in arrow direction "G" between roller 31 and associated roller group 7.1 of rollers 7 of pressure roller unit 4. The delivered sheet or film 36 is thereby pulled in arrow direction "G" and applied by roller 31 in rolled-on fashion onto surface 33 or a sheet present thereon. Rollers 7 of the other roller group 7.2 of pressure roller unit 4, which as already described are mounted independently rotatably, serve as support rollers for apparatus 35.

The delivered film 36 can be joined by means of a known thermal process (not depicted) to a surface 33 or to a support material (e.g. a sheet) lying on surface 33.

Roller 31 can, for example, be heated in a known manner (not depicted) so that it activates an adhesive present on film 36.

It is also possible, however, by means of rollers 7 of first roller group 7.1 of pressure roller unit, to apply an adhesive onto film 36 while it is being delivered to roller 31.

Apparatus 35 can be configured as a self-contained unit (not depicted) in which the flat surface 33 is located on a stationary plate 37 and carrier 32 is moved back and forth in motor-driven fashion on a guide (not depicted).

Apparatus 35 can, however, also be configured as a movable unit (not depicted) that is used to apply a film 36 onto an external surface 33 or a support material present thereon. To this end, apparatus 35 is simply pressed onto the external surface 33 and moved in arrow direction "E"; the movement can also be performed by activating a motor drive system of a type not depicted. With this embodiment as well, application of film 36 occurs as described above.

The invention has been described in detail with particular reference to certain preferred embodiments thereof, but it will be understood that variations and modifications can be effected within the spirit and scope of the invention.

PARTS LIST

1. Finisher
2. Transport Roller
3. Transport Roller
4. Pressure Roller Unit
4.1. Pressure Roller Unit
4.2. Pressure Roller Unit
5. Bearing Shaft
6. Bearing Bushings
6*a*. Bearing Region
6*b*. Cylindrical Running Surface
6*c*. Shoulder
6*d*. Second Side Surface
6*e*. Depression
6*f*. First Side Surface
6*g*. Disk-Shaped Region
6*h*. Projection
6*i*. Guide Surfaces
7. Rollers
7*a*. Bore
7*c*. Symmetrical Recesses
7*d*. End Surfaces
10. Input Tray
11. Stack
12. Decollating Roller
13. Guide Channel
14. Sheet Guide
16. Copy Sheets
17. Guide Element
18. Collection Container
19. Delimiter; Stop
20. Vane Wheel
21. Sheet Stack
22. Input Tray
23. Sheet Stack
24. Decollating Roller
25. Input Tray
26. Sheet Stack
27. Decollating Roller
28. Guide Channel
29. Guide Channel
31. Roller
32. U-shaped Carrier

33. Flat Surface
35. Apparatus
36. Film

What is claimed is:

1. Apparatus for transporting sheets, having a driven transport roller pair, said sheet transporting apparatus comprising:

a pressure roller unit resting against both transport rollers simultaneously is associated with the transport rollers of the transport roller pair;

the pressure roller unit has a plurality of rollers arranged next to one another and each independently rotatably mounted;

the pressure roller unit has a first and a second roller group with rollers, of which the rollers of the first roller group are mounted eccentrically by an amount (x) with respect to the longitudinal axis of the pressure roller unit, and the rollers of the second roller group are mounted eccentrically by the same amount (x), in the opposite direction from the rollers of the first roller group, with respect to the longitudinal axis of the pressure roller unit; and the rollers are arranged in such a way that of each two rollers arranged next to one another, one is associated with the first roller group and one with the second; and the rollers of the first roller group rest nonpositively against the one transport roller, and the rollers of the second roller group against the other transport roller.

2. Apparatus as defined in claim 1, wherein at least one further pressure roller unit rests nonpositively against the one transport roller and/or the other transport roller;

the further pressure roller unit simultaneously rests nonpositively against the pressure roller unit that is in engagement with the transport roller pair; and the rollers of the first roller group of the further pressure roller unit rest nonpositively against the transport roller, and the rollers of the second roller group against the pressure roller unit.

3. Sheet transporting apparatus as defined in claim 2, wherein the pressure roller unit has a stationary bearing shaft that is secured against rotation;

a plurality of bearing bushings are arranged on the bearing shaft, positioned next to one another and in its longitudinal direction;

the bearing bushings have a bearing region which joins positively to the bearing shaft and secures against radial rotation, as well as a cylindrical running surface;

the bearing region of the bearing bushings that is joined positively to the bearing shaft is arranged eccentrically with respect to the running surface of the bearing bushings;

identical rollers configured in rotationally synmmetrical fashion are mounted in freely rotatable fashion on the running surfaces of the bearing bushings; and the bearing bushings, in terms of their eccentric configuration, are arranged on the bearing shaft rotated alternatingly 180 degrees about their longitudinal axis with respect to one another in such a way that of each two rollers arranged next to one another, the one roller rests nonpositively with its circumferential surface against the one transport roller, and the other roller rests with its circumferential surface against the other transport roller.

4. Apparatus for transporting sheets, having a transport roller and a pressure roller, said sheet transporting apparatus comprising:

the pressure roller associated with the transport roller is configured as a pressure roller unit having a plurality of rollers arranged next to one another and each independently rotatably mounted;

the pressure roller unit has a first and a second roller group with rollers, of which the rollers of the first roller group are mounted eccentrically by an amount (x) with respect to the longitudinal axis of the pressure roller unit, and the rollers of the second roller group are mounted eccentrically by the same amount (x), in the opposite direction from the rollers of the first roller group, with respect to the longitudinal axis of the pressure roller unit; and the rollers are arranged in such a way that of each two rollers arranged next to one another, one is associated with the first roller group and one with the second; and the rollers of the first roller group rest nonpositively against the transport roller and the rollers of the second roller group can be driven in independently rotatable fashion in the opposite direction.

5. Sheet transporting apparatus as defined in claim 4, wherein the pressure roller unit has a stationary bearing shaft that is secured against rotation;

a plurality of bearing bushings are arranged on the bearing shaft, positioned next to one another and in its longitudinal direction;

the bearing bushings have a bearing region which joins positively to the bearing shaft and secures against radial rotation, as well as a cylindrical running surface;

the bearing region of the bearing bushings that is joined positively to the bearing shaft is arranged eccentrically with respect to the running surface of the bearing bushings;

identical rollers configured in rotationally symmetrical fashion are mounted in freely rotatable fashion on the running surfaces of the bearing bushings; and the bearing bushings, in terms of their eccentric configuration, are arranged on the bearing shaft rotated alternatingly 180 degrees about their longitudinal axis with respect to one another in such a way that of each two rollers arranged next to one another, the one roller rests nonpositively with its circumferential surface against the transport roller, and the other roller is driven independently rotatably in the opposite direction.

6. Sheet transporting apparatus as defined in claims 5, wherein the bearing bushings have at one end a shoulder which is greater in diameter than the diameter of the running surfaces; the shoulder defines, with its side surface facing the running surface, the axial position of the rollers arranged on the running surfaces; and the shoulder defines, with its side surface associated with the adjacent bearing bushing, the axial position of the roller arranged on the running surface of the respective adjacent bearing bushing.

7. Sheet transporting apparatus as defined in claim 6, wherein the side surface, associated with the adjacent roller, of the bearing bushing has a circular depression that is arranged eccentrically by twice the offset (x) with respect to the running surface of the bearing bushing; and the respective adjacent bearing bushing, arranged rotated 180 degrees about its longitudinal axis, engages into the depression.

8. Sheet transporting apparatus as defined in claim 7, wherein the rollers have on both of their end surfaces recesses into which the shoulder of the respective adjacent bearing bushing engages in such a way that the rollers can be installed directly next to one another but not touching one another, and the recesses are arranged symmetrically with respect to the roller.

9. Sheet transporting apparatus as defined in claim 8, wherein the bearing shaft has a substantially rectangular cross section; and the bearing shaft is arranged with respect to the associated roller and/or rollers in such a way that the longest extension of the rectangular cross section runs in the direction in which the pressure roller unit is pressed on.

10. Sheet transporting apparatus as defined in claim 9, wherein characterized in that the bearing region of the bearing bushings has a rectangular shape adapted positively to the cross section of the bearing shaft.

* * * * *